United States Patent [19]

Garner et al.

[11] 4,273,597

[45] Jun. 16, 1981

[54] FLUIDIZED POWDER FILLING OF CABLE CORE UNITS

[75] Inventors: John N. Garner, Pointe Claire; Arthur S. Hayes, Kingston, both of Canada

[73] Assignee: Northern Telecom Limited, Montreal, Canada

[21] Appl. No.: 74,492

[22] Filed: Sep. 11, 1979

Related U.S. Application Data

[63] Continuation-in-part of Ser. No. 921,252, Jul. 3, 1978, abandoned.

[51] Int. Cl.[3] ..... H01B 13/06

[52] U.S. Cl. ..... 156/48; 118/44; 118/DIG. 5; 118/DIG. 19; 156/47; 156/53; 174/102 P; 174/116; 174/118; 366/101; 427/117; 427/185

[58] Field of Search ..... 29/614, 616; 118/634, 118/44, DIG. 5, DIG. 19; 156/47, 48, 53; 141/250, 290; 174/102 P, 116, 118; 222/195; 338/238; 366/101; 427/117, 118, 120, 185

[56] References Cited

U.S. PATENT DOCUMENTS

| | | | |
|---|---|---|---|
| 3,889,455 | 6/1975 | Portinari et al. | 156/48 X |
| 4,100,002 | 7/1978 | Woytiuk et al. | 156/48 |
| 4,122,212 | 10/1978 | Walling et al. | 427/27 |
| 4,205,515 | 6/1980 | Garner | 156/48 X |

*Primary Examiner*—John T. Goolkasian
*Assistant Examiner*—Robert A. Dawson
*Attorney, Agent, or Firm*—R. J. Austin

[57] ABSTRACT

The conductors of a cable core unit are powder filled by passing the core unit through a fluidized bed of powder with the conductors substantially closed together. The filled cable core unit can be wrapped with tape after exit from the fluidized bed. Cable cores may be filled also by passing them through a fluidized bed. The core units of the cores may be closed together or separated, but the conductors of each unit are closed together.

12 Claims, 4 Drawing Figures

FLUIDIZED POWDER FILLING OF CABLE CORE UNITS

This application is a continuation-in-part of application Ser. No. 921,252, filed July 3, 1978 and now abandoned.

This invention relates to the powder filling of cable core units and to apparatus therefore.

Cable cores are made either as a single cable core unit or as a plurality of core units, each unit comprising conductors grouped together by twisting.

The powder filled cable cores are well known, the powder being applied to the cable in an "open" form, that is with the individual conductors spaced apart so that powder can be applied, as by blowing or otherwise expelling the powder.

Various problems exist with the known ways of filling a cable core unit, one of which is the obtaining uniformity of fill. It is important that filling be uniform as any variation causes variation in the electrical characteristics of the various layers. For telecommunications cables this is at least very undesirable, and in many instances unacceptable.

The present invention comprises a method of powder filling a cable core unit having a plurality of conductors, the method comprising passing the core unit through a fluidized bed with the conductors devoid of any surface covering which would prevent passage of powder between them, the conductors being substantially closed together and the powder flowing between the conductors to fill voids within the unit.

In the last preceding paragraph and elsewhere in this disclosure and claims, the term "fluidized bed" refers solely to a bed of powder which is fluidized and has a definite upper surface. Under certain operating conditions, dust or a cloud of powder particles may appear above the fluidized bed. Such dust or cloud is above the definite upper surface and is not considered as part of the bed.

It is found that the voids within a cable core unit become filled when the core unit is passed through the fluidized bed, i.e. below the definite upper surface, with the conductors substantially closed together, and acceptable uniformity of fill is produced.

The invention also applies to the powder filling of a cable core composed of a plurality of core units. Each of the core units is powder filled by keeping the conductors closed together. However, the core units themselves may be spaced-apart or closed together dependent upon the construction of cable core. For instance, where the core is composed of core units all of which lie at the outside of the core then it may be possible to powder fill the voids of all of the core units and between the core units by passing the core through the bed with the units closed together. Where, however, in a cable core construction, at least one core unit is used which is completely hidden from outside the cable core by outer units, then filling of voids of the central unit may be possible only by having the core units spaced-apart to enable the fluidized powder to pass between closed conductors of the central unit.

The invention also includes apparatus for powder filling a cable core unit having a housing with an inlet and outlet for a core unit at inlet and outlet ends of the housing, a porous member within the housing at a level below the inlet and outlet, a fluidizable bed of filling powder above the porous member, and means for feeding air through the porous member and into the powder to fluidize the powder, the quantity of powder being sufficient to produce a fluidized bed with a defined upper surface above the inlet and the outlet.

The invention will be readily understood by the following description of a process and the related apparatus, in conjunction with the accompanying diagrammatic drawings, in which.

Figure 1:
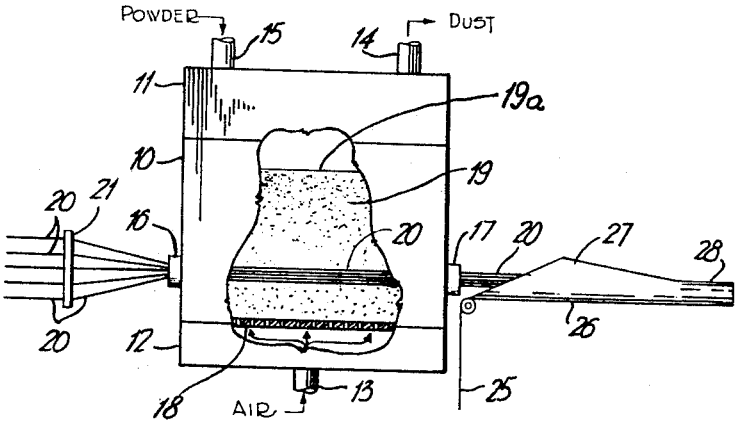
FIG. 1 illustrates, in side view, apparatus according to a first embodiment.

As illustrated in FIG. 1, the apparatus of the first embodiment comprises a main box or housing 10 having a top portion 11, an air box 12 at the bottom, an air inlet 13, a dust extraction outlet at 14 and a powder inlet 15. At an inlet end of the box 10 there is an inlet die 16 and at the other end of the box is an outlet die 17. The air box 12 is separated from the main box 10 by a porous plate 18.

In operation, powder is filled into the box 10, via inlet 15 and pressurized air is supplied to the air box 12 via the air inlet 13. The air passes through the porous plate 18 and fluidizes the powder in the box 10, as indicated at 19, there being sufficient powder to provide a definite upper surface **19*a* to the bed which is above the inlet and outlet dies. A certain amount of dust is created above surface 19*a* and this is extracted through the dust outlet 14**.

Prior to filling the box with powder the leading end of a cable core 20 is passed through the bore. The cable core has a single core unit which with its conductors twisted together, i.e. substantially closed, is fed through the inlet and outlet dies 16 and 17.

No part of the conductors have been oiled or greased prior to entry into the bed as such a procedure would hinder movement of filling powder between the conductors and into the voids within the core. In fact, the conductors of the core are devoid of any surface covering which would prevent passage of the powder into the voids. Likewise, the conductors are not electrostatically charged before entering the bed for the same reasons and the use of electrostatic filling methods forms no part of this invention. Hence, the core as passed into the bed in this embodiment is devoid of any means for attracting powder to the core surfaces at this would inhibit the flow of powder into the voids. As illustrated in FIG. 1 the conductors of the core unit are fed through a preforming guide 21 and then formed into cable core form as they pass through the inlet die 16. An initial length of formed and twisted conductors is fed through the box 10 and out through the outlet die 17. The twisted conductors can then be attached to a suitable lead member for connection to a pulling and take-up mechanism.

Once the leading end of the core is through the box it can be closed, powder fed in and the fluidizing air supply switched on. The core is then pulled through the box. As the core exits from the box, through exit die 17, it is wrapped in a core wrapping tape 25, by a former 26. In the particular example the former 26 comprises a tapered or conical entry portion 27 and a parallel portion 28. The former forms, or wraps, the wrapping tape 25 round the conductors 20, preventing loss of filling medium.

Figure 2:
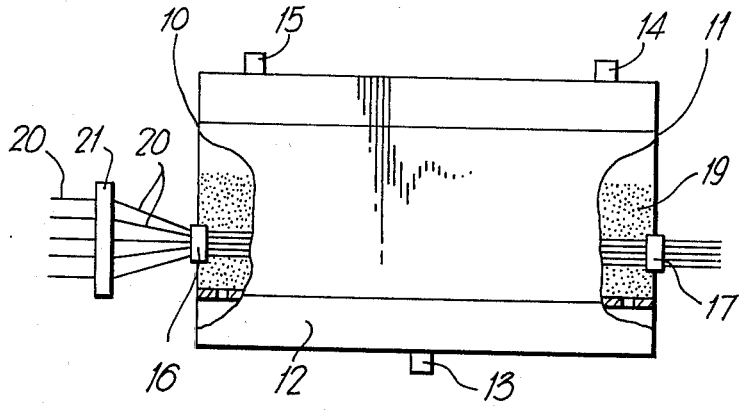
FIG. 2 illustrates in diagrammatic cross-section a cable core entering and passing through the apparatus.

The conductors 20 can be separate, individual conductors before assembling to form the core or, for telecommunications cables, may comprise pairs of conductors twisted together. The conductors are fed into the box 10 via the inlet die 16, in a substantially closed condition. Some slight spacing between conductors can occur, such as may occur due to slight opening of the conductors after exiting from the inlet die 16, but such opening is minimal. The degree of spacing can be varied, as by varying slightly the bore of the inlet die 16 to vary the amount of filling. Surprisingly, although the conductors are in a substantially closed condition, with probably several layers of conductors, uniform and complete filling is obtained, for core units with quite a large number of conductors. For example, satisfactory filling is obtained for a core unit of 25 pairs of conductors. The path of the conductors through the box 10 is illustrated in FIG. 2.

Figure 3:
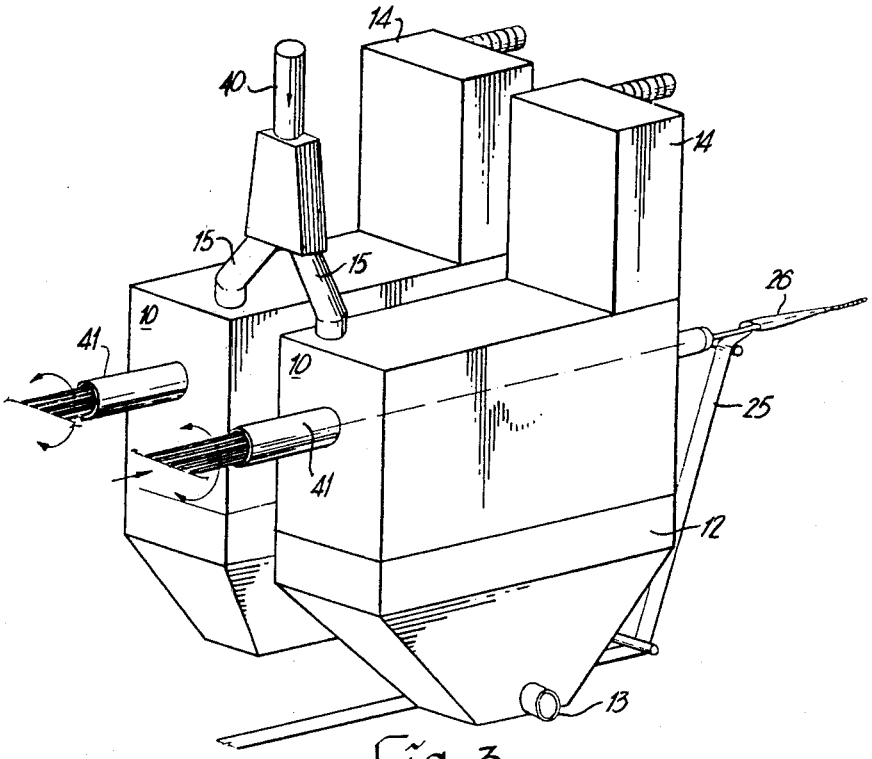
FIG. 3 is a perspective view of one form of apparatus for filling two cable cores.

FIG. 3 illustrates a typical form of apparatus for filling two cable core units in the particular example each of twenty-five pairs of conductors. Two boxes 10 are situated side by side with a common powder supply 40. In the example illustrated rotary oscillating faceplates 41 are provided at the inlet dies to reciprocate or oscillate the conductors as they pass through the boxes. The supply of powder is controlled to maintain a substantially constant bed thickness. In an alternate arrangement, not shown, a plurality of cable core units can be passed through a common bed.

The apparatus is relatively inexpensive, simple and very effective. The process results in uniformly filled cable core units, the filling being controlled and variable as desired. The cable core units have uniform electrical characteristics.

The invention is also applicable to the powder filling of cable cores each having a plurality of core units. For instance, in a modification of the first embodiment, a cable core comprising a plurality of core units with each core unit lying at the outside of the core, is passed through the fluidized bed with not only the conductors of each core unit substantially closed together but also the core units themselves being substantially closed together. With this arrangement, the voids between the conductors of each unit and the voids between the units are filled with powder.

Figure 4:
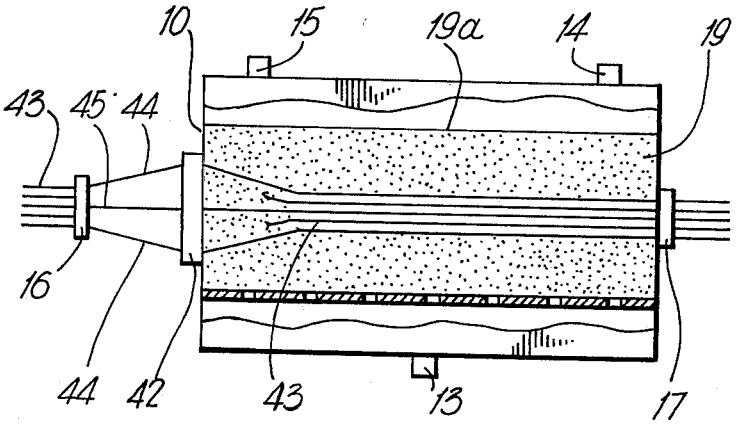
FIG. 4 is a side view in cross-sectional side elevation, of a second embodiment.

In a second embodiment shown in FIG. 4, in which parts similar to those described above, have the same reference numerals, a cable core opener 42 is disposed on the outside of the housing 10 between inlet and outlet dies 16 and 17. The core opener may be of a construction described in U.S. patent application Ser. No. 930,236, now U.S. Pat. No. 4,205,515, filed Aug. 2, 1978, in the name of John Nicholas Garner and with the present assignee. In this embodiment, each of the dies is made for the passage of a cable core 43 with a plurality of core units having outer core units 44 surrounding and enclosing at least one central core unit 45.

In use, the leading end of the core is fed through inlet 16, the core units are then separated and passed through the opener 42 with the outer core units 44 passing through holes towards the outside edge of the opener and the central core unit 45 passing through a centrally disposed hole. In FIG. 4 only two units 44 are shown. The units are initially spaced-apart within the bed and then recombine behind the opener as shown to reform the cable and this is passed through the bed and out of the outlet die 17.

In use, a pulling or take-up mechanism pulls the core through the fluidized bed. The opener is freely rotatable and is held in its position away from the inlet die. Thus as the core proceeds towards the opener, the core units are progressively separated to pass through the opener which rotates under the twist in the core units to allow them to recombine after passing through the opener. The core units while they are separated are filled with the fluidized powder which passes between the conductors of each unit, the conductors still being substantially closed together. The core units have been separated to expose the central unit 45 to the powder which is thus allowed to fill the voids in this unit also. After the units have recombined to reform the cable core 43, the fluidized powder also fills the voids between the core units before the core passes out through the outlet die.

What is claimed is:

1. A method of powder filling cable core units having a plurality of conductors, said method comprising:

fluidizing a bed of said powder to form a fluidized bed with a defined upper surface; and with the conductors of the cable core unit devoid of any surface covering which would prevent passage of powder between them, passing the core unit through the fluidized bed and beneath its defined upper surface with the conductors of the core unit substantially closed together, the fluidized powder in the bed flowing between the conductors to fill voids within the unit while avoiding attracting the powder to the conductors electrostatically.

2. A method according to claim 1, wherein the core unit is wrapped in a tape after exit from the fluidized bed.

3. A method of powder filling a cable core comprising a plurality of core units wherein the cable core is passed through the bed, and each core unit is powder filled as defined in claim 1.

4. A method according to claim 3 wherein in the cable core, the core units are substantially closed together during the whole passage of the core through the bed and voids between core units are filled with powder.

5. A method according to claim 3 wherein the cable core has a central core unit, and the core units are spaced-apart for part of the passage of the core through the bed to allow powder to fill voids in the central core unit, and after filling the voids in said central unit, the core units are substantially closed together for the remainder of the core passage through the bed to fill the voids with powder between the units.

6. Apparatus for powder filling cable core unit comprising:

a housing having a bottom and inlet and outlet ends;

at least one inlet for a core unit at said inlet end and at least one outlet for a core unit at the outlet end with the conductors substantially closed together;

a porous member located within the housing and extending across the housing at a level below the inlet and outlet;

a fluidizable bed of filling powder supported by the porous member; and means for feeding air through the porous member and into the powder to fluidize the powder, the quantity of powder being sufficient to produce a fluidized bed with a defined upper surface above the inlet and the outlet.

7. Apparatus according to claim 6 including an air box attached to the bottom of said housing, said means for feeding air including air supply means to said air box, said porous member being disposed between said air box and said housing.

8. Apparatus according to claim 7 including a top portion on said housing and dust extraction means connected to said top portion.

9. Apparatus according to claim 8 including wrapping means adjacent to said outlet for wrapping a tape around the core unit after passage of the core unit through the outlet.

10. Apparatus according to claim 6 including a preforming member positioned in front of said inlet for bringing the conductors into substantially closed relationship to form the core unit.

11. Apparatus according to claim 6 including an oscillating member at said inlet for oscillating the conductors as they pass through the housing.

12. Apparatus according to claim 6 having a cable core opener disposed upstream of the closing die to space core units of a cable core within part of the bed, and the outlet is of a size such as to pass a cable core of core units closed together.

* * * * *